US005638554A

United States Patent [19]

Corzine

[11] Patent Number: 5,638,554

[45] Date of Patent: Jun. 17, 1997

[54] CLAMP ASSEMBLY FOR QUICK FASTEN TOILET SEAT

[76] Inventor: John E. Corzine, 72 Cranberry Rd., Rochester, N.Y. 14612-1010

[21] Appl. No.: 538,075

[22] Filed: Oct. 2, 1995

[51] Int. Cl.[6] ..... A47K 13/12

[52] U.S. Cl. ..... 4/236; 4/240

[58] Field of Search ..... 4/234, 236, 237, 4/240, 241

[56] References Cited

U.S. PATENT DOCUMENTS

| | | | |
|---|---|---|---|
| 3,055,015 | 9/1962 | Silverman | 4/240 |
| 3,557,393 | 1/1971 | Waldon | 4/236 |
| 4,271,539 | 6/1981 | Roberts | 4/236 X |
| 4,309,780 | 1/1982 | Fantetti | 4/234 |

*Primary Examiner*—Robert M. Fetsuga

[57] ABSTRACT

A clamp assembly for mounting a toilet seat hinge to a toilet fixture. An arm holder is inserted into a toilet seat mounting hole and includes a laterally extending flange engaging the toilet fixture and a through shaft hole. An elongate shaft is slidably and rotatably disposed in the shaft hole and includes a substantially perpendicularly extending pad at one end. A knob is adjustably secured to an opposed end of said shaft. A compression spring is disposed around the shaft and extends between the arm holder flange and the knob. A seat hinge mounting hole of a toilet seat is disposed on the shaft with the seat hinge between the arm holder flange and the spring such that the shaft pad can be extended and rotated by the knob to engage the toilet fixture under surface to clamp the assembly to the fixture under bias of the spring.

4 Claims, 2 Drawing Sheets

CLAMP ASSEMBLY FOR QUICK FASTEN TOILET SEAT

TECHNICAL FIELD

This invention concerns a device to fasten covering elements onto a sanitary fixture, such as toilets or bidets, and particularly to a fastening apparatus to mount the corresponding seat/cover assemblies onto toilets.

BACKGROUND OF INVENTION

Toilet seats are removed for replacement, repairs to the toilet, and cleaning. Most toilet seat assemblies are presently fastened to the toilet by means of fasteners which insert from the top of a hole and into a connector on the bottom of the hole, the most familiar example being a nut and bolt. Such assemblies require the use of tools for installation and removal. Metal fasteners tend to corrode and bind while plastic fasteners of this type tend to loosen with use. Recognition of the difficulties presented in such fasteners has prompted several alternative assemblies.

U.S. Pat. No. 2,004,023, discloses a toilet mounted 'D' hole fixture into which a seat hinge 'D' pin slides down into.

U.S. Pat. No. 2,593,534, discloses a cam locking fastener, which replaces the nut in a typical toilet seat assembly.

U.S. Pat. No. 3,055,015, discloses a releasable hinge assembly which has an expandable section at the base of the fastener which can be contracted by squeezing. The expanded section replaces the nut.

U.S. Pat. No. 3,449,774, discloses an attachment device having a deformable sleeve which expands at sides and base to hold the seat. Deformation is done by an internal nut.

U.S. Pat. No. 5,396,663, discloses an eccentric central spindle that when turned deforms and expands a sleeve which fits into a toilet seat mounting hole.

Fasteners with expandable and deformable sleeves are used for attaching and sealing a number of devices. Among the earliest of these are bottle stoppers such as those shown in U.S. Pat. Nos. 408,364, 875,397, and 1,212,871. Fasteners include U.S. Pat. No. 2,365,372, which is a hold-down attachment for a trolley seat. However, these generally have used a cylindrical center, which expands a cylindrical sleeve. Devices which use permanently installed pieces are unsatisfactory since the piece traps dirt.

It is desirable to have a fastener which makes it easy to install or remove a toilet seat assembly, and has no part permanently fastened to the toilet. It is also desirable to have a fastener which provides a compressing force to attach the fastener to the ceramic toilet fixture. In addition, the fastener should not use expandable or deformable components which degrade with use and are hard to clean.

SUMMARY OF THE INVENTION

It is an objective of this invention to provide a means of removing and installing a toilet seat assembly easily and completely, from above the toilet fixture structure.

It is also an objective of this invention to provide a device that replaces the nut, bolt and washers that typically secure toilet seats. The replacement device would require no modification to existing toilet seat hinge assemblies.

The present invention consists of an insert/arm holder, with the arm being the toilet seat hinge mounting arm. Through an offset center hole in the insert/arm holder is placed a coil spring loaded clamp pad attached to a rotating shaft. At the top of the shaft is a knob used to twist the shaft.

The hole through the hole insert/arm holder used by the shaft is placed off center from the center of the insert/arm holder. The insert/arm holder is placed into the toilet seat mounting holes.

DETAILED DESCRIPTION

Figure 1:
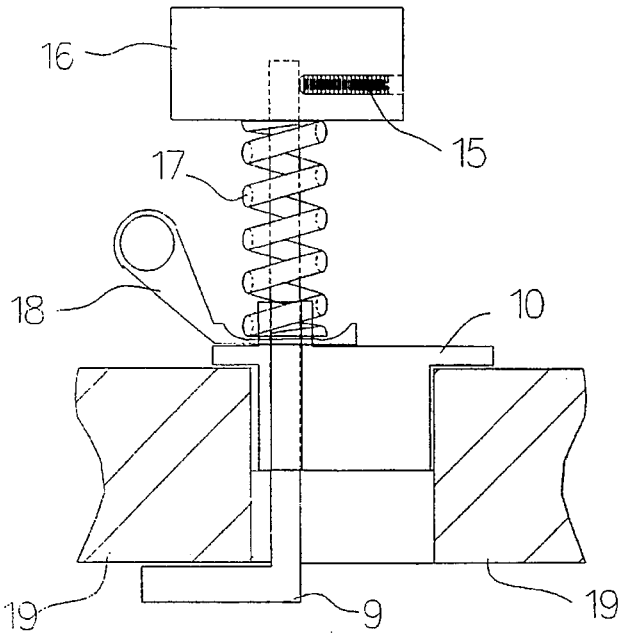
FIG. 1 is side view of a clamp fastener in use on a toilet fixture.

FIG. 1 shows a preferred embodiment of the invention in use. The assembly has an insert/arm holder 10 placed into the toilet fixture 19 (shown for reference) seat mounting hole. The typical style of a toilet seat mounting pad 18 (shown for reference) is shown placed on the mounting flange 11 (FIG. 3) of the insert/arm holder 10. The shaft/pad 9 is inserted into hole 13 (FIG. 3) of the insert/arm holder 10. Compression spring 17 is shown placed onto shaft/pad 9 and over mounting flange 11 (FIG. 3) and sitting on top of toilet seat mounting pad 18. Knob 16 is secured to shaft/pad 9 with set screw 15. Compression spring 17 is shown compressed and shaft/pad 9 is shown turned to the clamped position.

The compression force of spring 17, shown compressed, against toilet seat hinge mounting arm 18 and circular flange 12 (FIG. 3) and the compression force of spring 17 against knob 16 which pulls shaft/pad 9 provides a clamping force to toilet seat fixture 19 securing clamp assembly to toilet fixture seat mounting hole.

The off-center hole 13 (FIG. 3) of the insert/arm holder 10 allows for the clamp assembly to be inserted into the toilet fixture seat mounting hole when knob 16 turns 180 degrees either direction from its position shown in FIG. 1.

Figure 2:
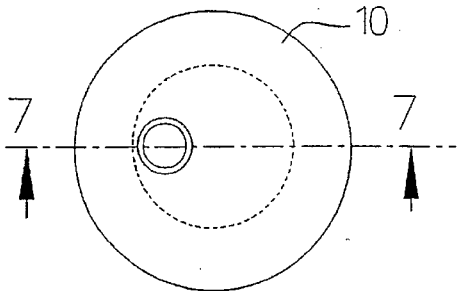
FIG. 2 is a top view of the insert/arm holder.
Figure 3:
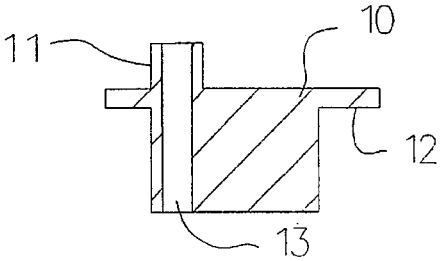
FIG. 3 is a cross sectional view of the insert/arm holder with cross section defined by line 7 of FIG. 2.

FIG. 2 showing the top view of the insert/arm holder 10 also specifies the sectional line 7 for use in the FIG. 3 cross sectional view of the insert/arm holder 10.

FIG. 3 mounting flange 11 provides a holder for a toilet seat hinge mounting arm 18 (FIG. 1 and FIG. 5) and also serves as a centering guide for compression spring 17 (FIG. 1 and FIG. 5). The shaft/pad 9 (FIG. 1, 4, 5) and the universal shaft/pad 24 (FIG. 6) is reciprocally mounted longitudinally in the insert/arm holder 10 for protraction, retraction and rotation through the hole 13 (FIG. 3). Circular flange 12 rests on a toilet fixture and functions as a clamp pad.

Figure 4B:
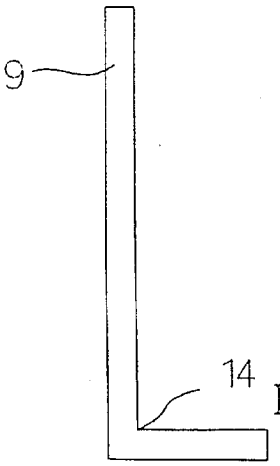
FIGS. 4*a* and 4*b* is a side and top view of the shaft/pad.
Figure 4A:
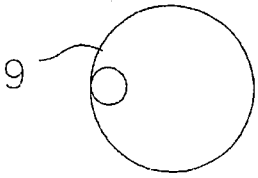

FIGS. 4*a* and 4*b* shaft/pad 9 is shown in a side and top view. The joining of the shaft to the circular pad at 14 the edge of the circular pad results in an eccentric motion of the pad when the shaft is rotated.

Figure 5C:
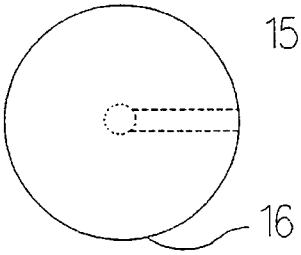
FIGS. 5*a*, 5*b* and 5*c* is a side view of complete assembled clamp fastener with toilet seat hinge mounting arm shown for reference.
Figure 5B:
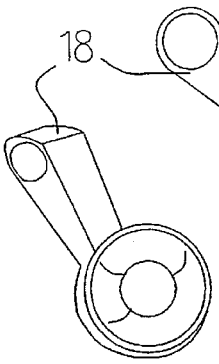
Figure 5A:
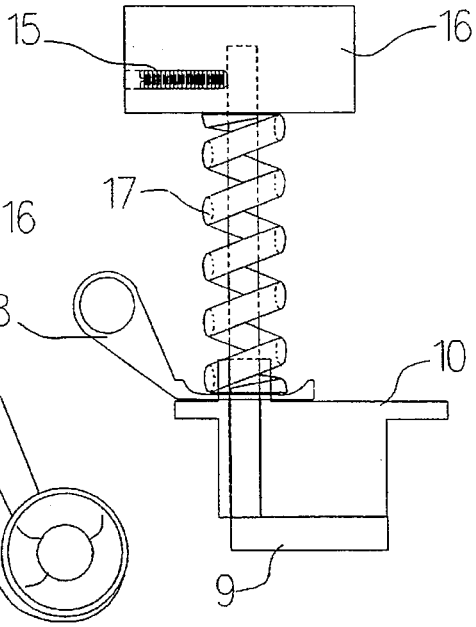
Figure 6C:
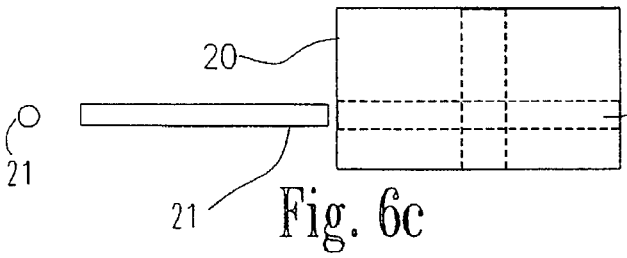
FIGS. 6*a*, 6*b*, 6*c* and 6*d* is a side view of universal shaft/pad and quick install knob.
Figure 6D:
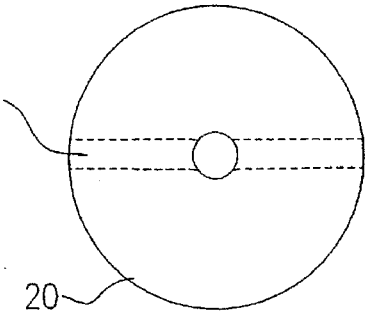
Figure 6B:
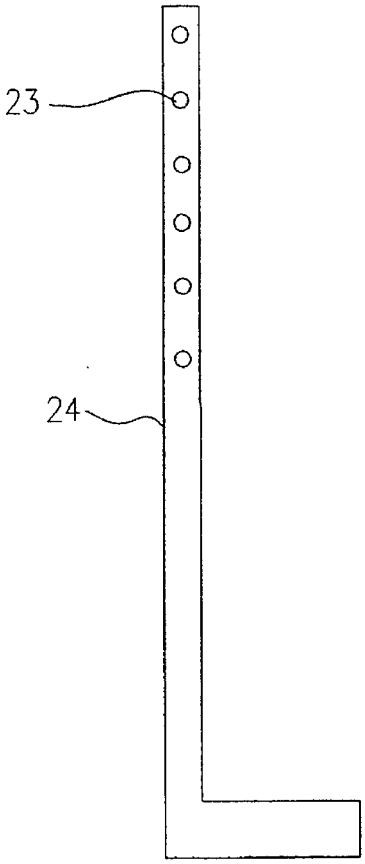
Figure 6A:
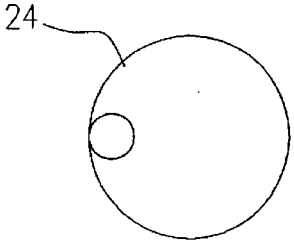

FIGS. 5*a*, 5*b* and 5*c* is a clamp assembly shown in the closed or insertable position, ready to be inserted into a toilet fixture seat mounting hole. The toilet seat hinge mounting arm 18 is shown as an example of the typical type of arm to be used with the clamp assembly.

FIGS. 6*a*, 6*b*, 6*c* and 6*d* is a universal shaft/pad 24 for use when the depth of toilet fixture 19 (FIG. 1) seat mounting hole is unknown. The placement of spaced holes 23 along the shaft of shaft/pad 24 allows for cutting off or removing excess shaft length, and then inserting shaft of shaft/pad 24 into vertical hole of knob 20. Knob 20 has a horizontal hole 22 into which is inserted rod 21 which joins knob 20 and shaft/pad 24.

Usage as defined above in FIG. 6 description, the universal shaft/pad 24 and Knob 20 and Rod 21 would replace shaft/pad 9 (FIG. 1, 4 and 5) and Knob 16 and Set Screw 15 (FIG. 1 and 5).

Suitable materials for the manufacture of the clamp include metal and polymers.

What is claimed is:

1. A clamp assembly for mounting a toilet seat hinge having a mounting hole to a toilet fixture having a seat hinge mounting hole extending between first and second surfaces, comprising:

an arm holder for insertion into the toilet fixture mounting hole, said arm holder including a laterally extending flange at one end portion thereof for engagement with the toilet fixture first surface, and a shaft hole extending therethrough;

an elongate shaft slidably and rotatably extending through said shaft hole, said shaft including a pad extending substantially perpendicularly from one end portion thereof;

a knob adjustable secured to an opposed end portion of said shaft; and a compression spring disposed around said shaft and extending between said arm holder flange and said knob, whereby the seat hinge mounting hole can be disposed on said shaft with the seat hinge between said arm holder flange and said spring such that said shaft pad can be extended and rotated by said knob to engage the toilet fixture second surface to clamp the assembly to the fixture under bias of said spring.

2. The assembly of claim 1 wherein said shaft hole is positioned off-center with respect to said arm holder.

3. The assembly of claim 1 wherein said adjustable securement of said knob includes said knob having a shaft receiving hole and a set screw.

4. The assembly of claim 1 wherein said adjustable securement of said knob includes said shaft having a plurality of spaced holes and said knob having a shaft receiving through-hole and a transverse hole, said adjustable securement further including a rod extending through said transverse hole and a selected one of said plurality of spaced holes.

* * * * *